United States Patent [19]

Isom

[11] Patent Number: 4,949,797

[45] Date of Patent: Aug. 21, 1990

[54] DRILL PIPE

[76] Inventor: John R. Isom, 7251 Poppy Way, Golden, Colo. 80403

[21] Appl. No.: 397,846

[22] Filed: Aug. 24, 1989

[51] Int. Cl.[5] ..... E21B 17/02; E21B 17/18; E21B 17/22

[52] U.S. Cl. ..... 175/317; 166/65.1; 175/215; 175/323; 285/133.1

[58] Field of Search ..... 166/242, 65.1; 175/323, 175/320, 215, 317; 285/133.1, 138; 174/47, 75 C

[56] References Cited

U.S. PATENT DOCUMENTS

| | | | |
|---|---|---|---|
| 1,024,310 | 4/1912 | Canfield . | |
| 1,628,033 | 5/1927 | Davis . | |
| 1,746,132 | 2/1930 | Stokes . | |
| 2,494,803 | 1/1950 | Frost et al. | 175/215 |
| 3,065,807 | 11/1962 | Wells | 285/133.1 X |
| 3,265,091 | 8/1966 | De Jarnett | 138/114 |
| 3,489,438 | 1/1970 | McClure | 285/133.1 |
| 3,638,970 | 2/1972 | Sandquist et al. | 285/133.1 |
| 3,897,097 | 4/1975 | Oertle | 174/47 X |
| 3,928,903 | 12/1975 | Richardson et al. | 29/407 |
| 4,067,596 | 1/1978 | Kellner et al. | 175/215 X |
| 4,280,535 | 7/1981 | Willis | 138/112 |
| 4,423,778 | 1/1984 | Goldsmith | 166/134 |
| 4,683,944 | 8/1987 | Curlett | 166/65.1 |

*Primary Examiner*—Stephen J. Novosad

*Attorney, Agent, or Firm*—Laney, Dougherty, Hessin & Beavers

[57] ABSTRACT

An improved drill pipe assembly wherein each pipe section is formed as a concentric walled pipe having both an axial and an annular space therethrough, and the pipe section includes means for communicating the adjoining annular spaces through the series of respective box end/pin end joints whereby equipment compartmentation, conductor traverse, ballast containment, gas pressurization and weight addition can be effectively utilized in controlled manner.

16 Claims, 3 Drawing Sheets

DRILL PIPE

BACKGROUND OF THE INVENTION

1. Field of the Invention

The present invention relates generally to a form of concentric tube drill pipe and, more particularly, but not by way of limitation, it relates to improved drill pipe that enables wide variance in weight and buoyancy while containing space for continuous communication and electronic modules, such drill pipe being particularly adaptable for extended horizontal or deviated drilling applications.

2. Description of the Prior Art

Dual tube concentric drill pipe has been known for a long number of years as it has been utilized for obtaining various advantages in the drilling operation. An early U.S. Pat. No. 1,024,310 proposed a concentric drill pipe intended for boring shallow oil or artesian wells with reduced danger of blocking the hole as might be caused by breaking of the drill bit downhole. A U.S. Pat. No. 1,746,132 taught a concentric drill pipe wherein an annulus portion forms a sealed chamber for air or other gas which serves to lessen the weight of the drill stem.

A U.S. Pat. No. 3,928,903 teaches a specific form of construction for concentric drill pipe using only threaded interconnector means in the assembly. U.S. Pat. No. 4,280,535 teaches yet another form of concentric drill pipe that utilizes a more basic approach wherein a conventional form of drill pipe contains a smaller diameter pipe extending axially therethrough while being concentrically spaced by a number of spacer lugs. Finally, U.S. Pat. No. 3,265,091 is of interest for its teaching of concentric drill pipe that provides an annular space for carrying fluid or other material for the purpose of damping vibrations set up during drilling activity.

SUMMARY OF THE INVENTION

The present invention relates to improvements in concentric drill pipe wherein the annular space is capable of several different functions while also providing conduit and housing for electronics and interconnection. The inner pipe is threadedly secured between the box end and pin end of the concentric pipe assembly and passages are provided for intercommunication between the annular spaces of adjacent drill pipe assemblies. In addition, an interconnecting cable may be continuously aligned through the series of drill pipe assemblies as a make-up space is provided beneath the box end thread to provide a length of cable sufficient to allow for differential rotation of adjoining pipe assemblies during make up.

Therefore, it is an object of the present invention to provide a drill pipe assembly that is particularly useful for long distance horizontal and deviated well drilling.

It is also another object of the invention to provide a drill pipe assembly capable of permitting continuous electrical connection along a drill string.

It is still further an object of the present invention to provide a drill pipe assembly that allows greater range of adjustment for weight and buoyancy thereby to increase likelihood of the drill string remaining in continuous operation for longer periods of time.

Finally, it is an object of the present invention to provide a drill pipe assembly having improved operational capability in horizontal and deviation drilling applications.

Other objects and advantages of the invention will be evident from the following detailed description when read in conjunction with the accompanying drawings which illustrate the invention.

DETAILED DESCRIPTION OF THE INVENTION

Figure 1:
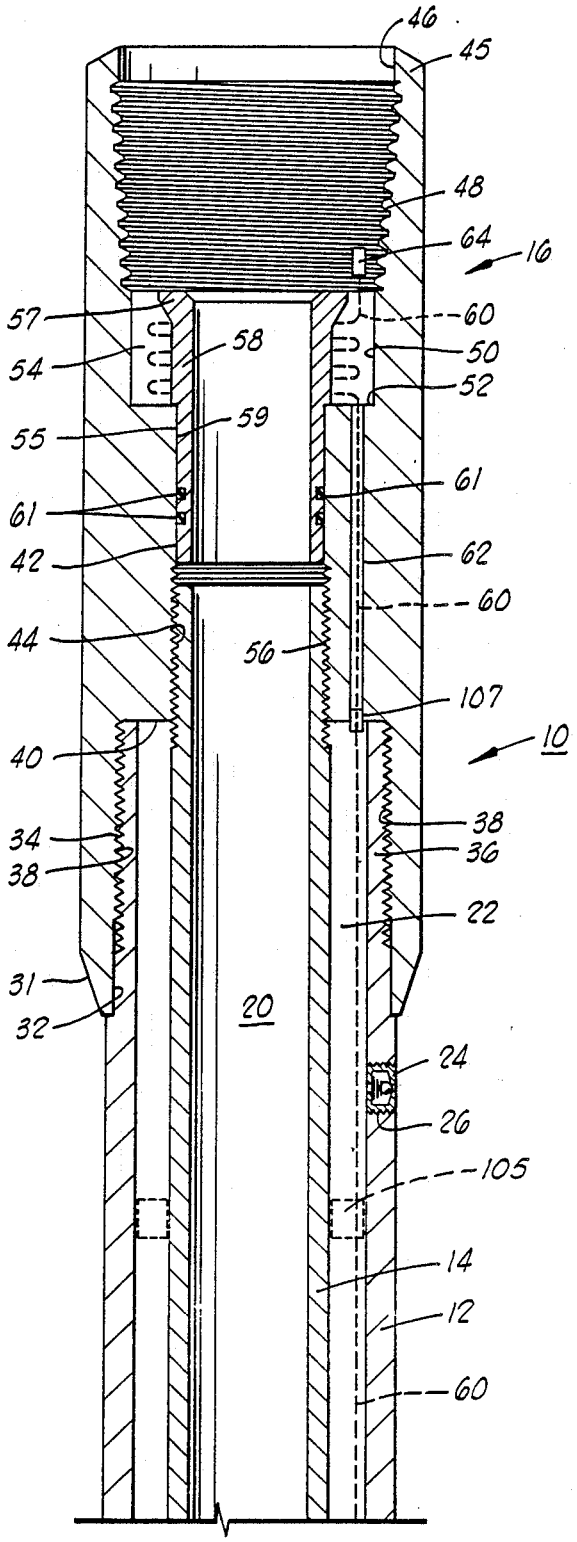
FIG. 1 is a view in cross-section of the box end portion of a drill pipe assembly.
Figure 2:
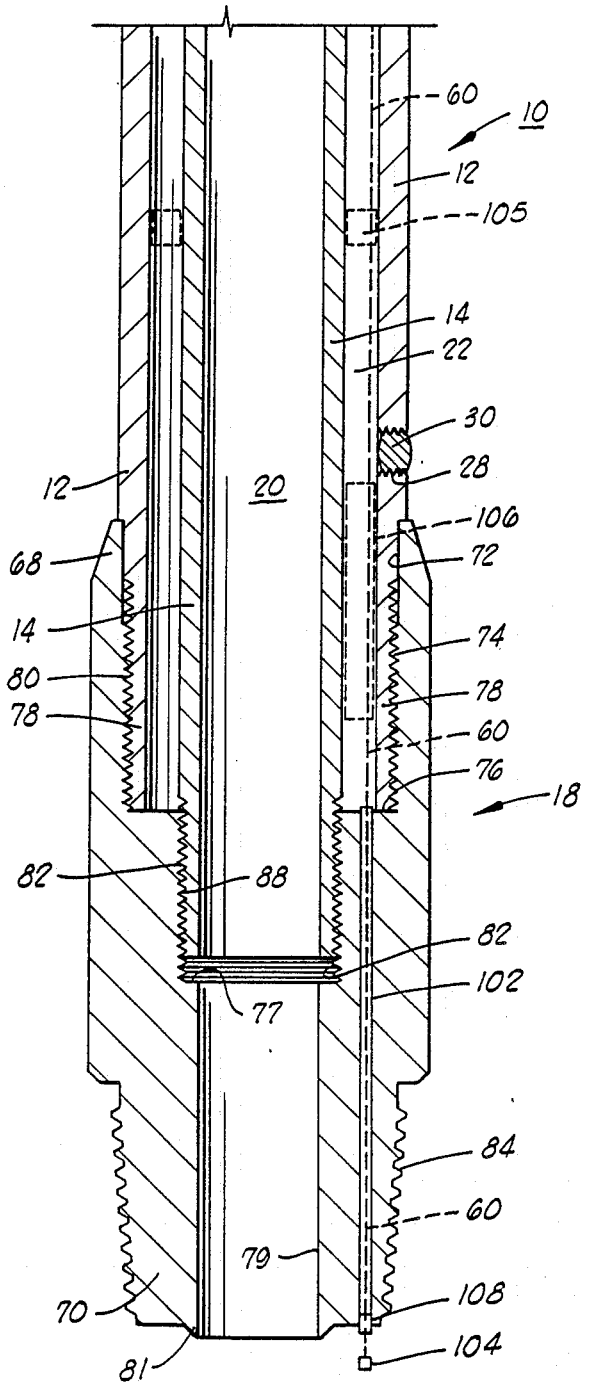
FIG. 2 is a vertical cross-section of the pin end portion of the drill pipe assembly.

Referring to FIGS. 1 and 2, a drill pipe assembly 10 consists of an outer pipe 12 and a concentric, inner pipe 14 as secured at one end to a box end tool joint 16 and at the other end to a pin end tool joint 18. The outer pipe 12 may be a conventional drill pipe having requisite inner and outer diameter measurements, and the inner pipe 14 is selected to provide a sufficient balance as between the cross-sectional area of an inner bore 20 and an annular space 22. Access for entry of fluids and gas under pressure is provided by a check valve 24 threadedly received through the outer pipe 12 by means of threaded bore 26. Also, a threaded bore 28 sealed by threaded plug 30 provides access for entry of solids such as lead shot or other weighting medium.

Referring to FIG. 1, the end 31 of box end joint 16 has an axial bore 32 formed with internal threads 34 for receiving securely therein an upper end 36 of outer pipe 12 having threads 38. The bore 32 extends sufficiently within box end joint 16 to assure seal-tight threaded insertion while terminating in an annular shoulder 40 and a second axial bore 42, a smooth bore having an inner part formed as a threaded collar 44.

The opposite end 45 of box end joint 16 is formed with an axial bore 46 and the conventional form of tapered coupling threads 48 for receiving a pin end connection. The inner end of taper threads 48 is then formed into a bore 50 terminating in annular shoulder 52 and defining a sufficient cylindrical space 54 that is suitable for formation of a cable coiling space, as will be further described.

The inner pipe 14 may then be inserted and joined concentrically by engagement of threads 56 through the threaded collar 44 portion within bore 42. A cylindrical insert 55 having outer seating flange 57 and smooth barrel 59 is inserted within the smooth bore 42. Plural groove-seated O-rings 61 around barrel 59 provide tight, sealed seating of insert 55. The upper end pipe portion 58 with flange 57 protrudes into the cylindrical volume 54 in position for mating engagement with a pin end nipple formation, as will be described. A wire or multi-conductor cable 60 of selected size and type is then threaded around volume 54 and downward through a circular passage 62 to extend the length of the annular space 22. A suitable quick-release receptacle 64 is coupled on the end of cable 60 and sufficient coils of cable are reserved around upper end 58 of inner pipe 14 to allow for sufficient rotation of the pipe assemblies during make up of a tool joint.

Referring to FIG. 2, the pin end joint member 18 has opposite ends 68 and 70 for affixure over the opposite end of outer pipe 12 and inner pipe 14. The end 68 includes an axial bore 72 which includes threads 74 that terminate in an annular shoulder 76. An end 78 of outer pipe 12 includes threads 80 and is adapted to be sealingly received within threads 74 of axial bore 72.

A further threaded bore 82 is formed to extend axially from annular shoulder 76 down to a shoulder 77 leading into a smooth bore 79. The inner tube 14 has lower threads 88 for mating engagement within threaded bore 82. Pin end 70 is formed with taper threads 84 for mating engagement with a box end connector. The outer end of bore 79 is formed as a conical surface lip 81 for mating abutment with flange 57 (FIG. 1) when the joint is made-up.

A suitable circular bore or passage 102 is formed from annular shoulder 76 through the pin end 70 to receive cable 60 therethrough whereupon a suitable quick-release connector 104 is attached. The connector 104 is adapted for secure connection to a mating receptacle such as receptacle 64 at the opposite end of a pipe assembly. Suitable electronics modules such as shown in dash-line 106 may be located in the annular space 22 and retained in safe, insulated positioning, and such electronics modules may be connected into the multi-conductor circuit provided by cable 60. One or more spacers or equalizers 105 may be utilized to maintain concentricity of inner tube 14.

In assembly of the pipe assembly 10, the outer tube 12 and inner tube 14 may first be threadedly engaged within the box end member 16 with subsequent threading of cable 60 through bore 62 and placement of sealing plugs (or valves) 24 and 30. The pin end member 18 may then be threadedly engaged with threads 74 on threads 80, and simultaneous engagement of threads 82 on inner pipe threads 88 until the entire assembly is rigidly secured.

In operation, when making up a tool joint between two pipe assemblies 10, the pin end member 18 and nipple tube 94 will be lowered into the box end member 16. A sufficient number of turns of cable 60 will have been layed around inner tube end 58 in counter rotating relationship, and receptacle 64 will have been engaged with the connector 104 of the succeeding pin end position. The pin end member 18 is then rotated a sufficient number of turns to securely engage threads 84 within threads 48 for continuation of drilling activity. A suitable spring clip or other retention member may be employed within the cylindrical volume 54 to insure that cable 60 and the connectors do not get caught or crushed by the mating pipe members.

Prior to connection of the drill pipe assemblies 10 into the drill string, the annular spaces 22 in each assembly will have been charged with material to aid in the drilling process. When drilling in a horizontal or near horizontal attitude it may be desirable to pump air under pressure through check valve 24 thereby to increase the rigidity of the pipe string within the well fluids. In other applications, and certain deviated directional operations, it may be desirable to vary the weight condition of annular space 22 by either introduction of a fluid or gas through check valve 24 or placement of lead shot or some other weighting material through the plug 30. Introduction of nitrogen under pressure can be done for insulation effect in geothermal well-drilling, and a gas at high pressure can serve to strengthen the drill pipe for compressive use. The filling part of the operation can be attended to before the individual pipe assemblies are taken to the rig floor for positioning in the string. Suitable feed-through sealing plugs 107, 108 may be used to seal the passages 62 and 102 to ensure pressure isolation of annular space 22.

Figure 3:
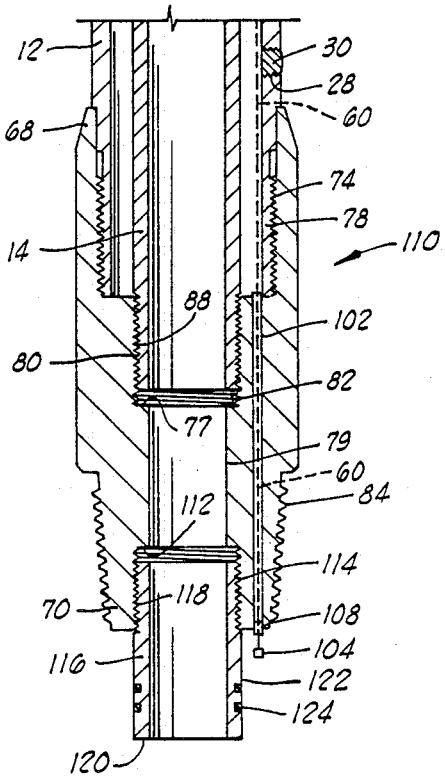
FIG. 3 is a view in cross-section of an alternative form of pin end pipe construction.

FIG. 3 represents an alternative form of pin end tool joint 110 that may be used with the box end tool joint 16 after the cylindrical insert 55 has been removed. Thus, the lower portion of bore 79 is formed with a counterbore defining annular shoulder 112 and internal threaded bore 114. All of the remaining structure is identical to the pin end tool joint 18 of FIG. 2.

Tool joint 110 includes a cylinder 116 having threads 118 around one end for threaded insertion in engagement with internal threads 114. The opposite end of cylinder 116 then protrudes axially from pin end 70 to a terminus 120 that is diametrically sized for close insertion within smooth bore 42 (FIG. 1) of a box end joint 16. One or more circumferal grooves 122 with seated O-rings 124 provides sealing affixure when the box end/pin end joint is made-up with cylinder 116 slid into smooth bore 42.

Figure 4:
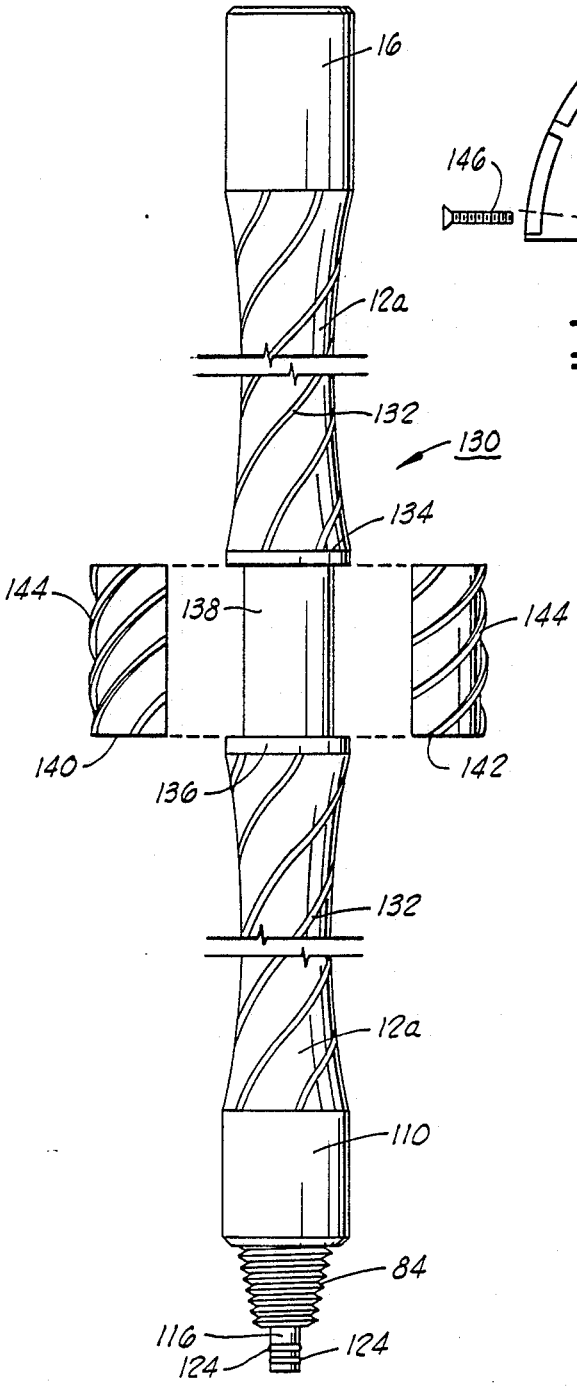
FIG. 4 is a plan view of a drill pipe assembly constructed in accordance with the present invention and shown with central parts exploded therefrom.

FIG. 4 illustrates a pipe assembly 130 that is particularly useful in horizontal and deviated directional drilling operations. Thus, the outer pipe **12*a* is formed with an elongated spiral groove or pattern of grooves 132 which lessens the probability of sticking during rotation. The groove structure tends to break up surface tension and cause a clearing activity along the length of pipe assembly 130. Still further, the pipe 12*a* may include the formation of upset collars 134 and 136, spaced by about two feet, and defining a cylindrical surface 138 therebetween. A pair of semi-cylindrical shoes 140 and 142 may then be bolted in cylindrical surface 138 by suitable recessed fasteners. The shoes 140 and 142 each carry a series of spiral paddles or vanes 144** formed on the outer diameter.

Figure 5:
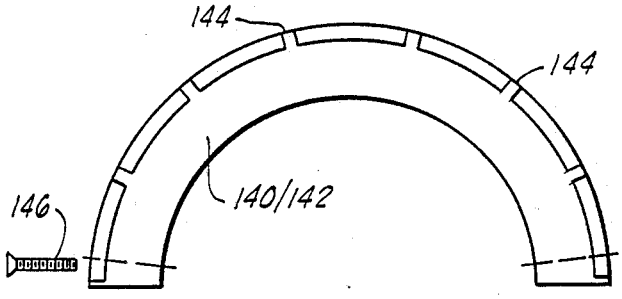
FIG. 5 is an end view shown in elevation of a semicylindrical contact shoe as shown in FIG. 4.

FIG. 5 illustrates an end view of a semi-cylindrical shoe 140/142 and its vane structure 144. With such as the vane structure 144 disposed generally centrally of outer pipe **12*a*, there tends to be a spiral paddling effect that aids in maintaining movement of outcoming drilling fluid and particles. The shoes 140/142 may be secured about surface 138 by means of a plurality of recessed fasteners such as bolt 146**.

The foregoing discloses a novel form of dual tube concentric drill pipe that includes an annular space that can function in any of several different ways to aid in a drilling operation, particularly in horizontal and greatly deviated well drilling applications. The annular space provided in the drill pipe assembly of the present invention can be charged or filled by selected liquids, gases or solids to derive attributes of buoyancy, increased weight, heat insulation, increased compressive strength, etc. In addition, the present dual pipe design enables the inclusion of continuous cable interconnection through the pipe annulus and respective pipe joints while electronic modules for sensing, amplification, transmitting and such can be safely positioned in the annular space.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. An improved drill pipe assembly wherein each drill pipe comprises:

an outer pipe;

an inner pipe disposed within said outer pipe to define a normally sealed annular space, said inner pipe having a predetermined inner diameter;

a box end joint having first and second ends with the second end rigidly secured to each of said outer and inner pipes and the first end having internal box end threads for drill pipe interconnection;

a pin end joint having first and second ends with the second end rigidly secured to each of said outer and inner pipes and the first end having pin end external threads for drill pipe interconnection;

a short cylindrical pipe means for sealed insertion within one of said box end and pin end joints to provide communication between the inner pipes of a box end and pin end when joined; and means providing access selectively to said normally sealed annular space.

2. A drill pipe assembly as set forth in claim 1 wherein said means providing access comprises:

a first sealable passage formed in the box end joint in parallel with the inner pipe and extending from the annular space through the box end joint first end.

3. A drill pipe assembly as set forth in claim 1 wherein said means providing access comprises:

a sealable passage formed in the pin end joint in parallel with the inner pipe and extending from the annular space through the pin end joint first end.

4. A drill pipe assembly as set forth in claim 2 wherein said means providing access comprises:

a second sealable passage formed in the pin end joint in parallel with the inner pipe and extending from the annular space through the pin end joint first end.

5. A drill pipe assembly as set forth in claim 1 wherein said means providing access comprises:

a removable, sealed plug through the outer pipe.

6. A drill pipe assembly as set forth in claim 1 wherein said means providing access comprises:

a removable check valve sealingly seated through said outer pipe.

7. A drill pipe assembly as set forth in claim 4 which is further characterized to include:

an electrical cable having at least one conductor extending through the box end joint first hole, the annular space and the pin end joint second hole, and having means for connecting on each end.

8. A drill pipe assembly as set forth in claim 4 which further includes:

means for sealing each of said first and second holes.

9. A drill pipe assembly as set forth in claim 7 which further includes:

means for sealing each of said first and second holes.

10. A drill pipe assembly as set forth in claim 7 which is further characterized in that:

said box end joint includes an axial cavity formed centrally between the internal threads and said inner pipe, said cavity serving to store a selected length of said electrical cable for release during drill pipe assembly relative rotation that occurs during joint make up.

11. A drill pipe assembly as set forth in claim 1 which is further characterized to include:

cylindrical shoe means secured generally centrally on said outer pipe and carrying a plurality of helical paddle means for agitating and moving along fluid and particulate matter in the borehole.

12. A drill pipe assembly as set forth in claim 11 which further includes:

at least one spiral striation along said outer pipe for reducing differential surface tension therealong.

13. A drill pipe assembly as set forth in claim 11 wherein said cylindrical shoe means comprises:

first and second semi-cylindrical shoes each extending spiral ridge structure therealong.

14. A drill pipe assembly as set forth in claim 4 which is further characterized to include:

cylindrical shoe means secured generally centrally on said outer pipe and carrying a plurality of helical paddle means for agitating and moving along the fluid and particles in the borehole.

15. A drill pipe assembly as set forth in claim 1 wherein said cylindrical pipe means comprises:

a cylinder pipe portion that is closely received axially within the box end joint first end and defines an inner diameter the same as that of said inner pipe;

a flange formed on said cylinder pipe portion end for disposition adjacent and centrally of said internal box end threads; and sealing rings retained on said cylinder pipe portion in sealing contact with the box end joint first end.

16. A drill pipe assembly as set forth in claim 1 wherein said cylindrical pipe means comprises:

a cylinder having first and second ends with the first end threadedly received axially within the pin end joint first end, the cylinder defining an inner diameter that is the same as that of said inner pipe; and sealing rings retained on said cylinder second end to maintain sealing relative to the box end joint first end.

* * * * *